US011312036B2

(12) United States Patent
Shiel

(10) Patent No.: US 11,312,036 B2
(45) Date of Patent: Apr. 26, 2022

(54) TABLE SAW FENCE WITH TENSION ADJUSTMENT CAM

(71) Applicant: Robert Bosch GmbH, Stuttgart (DE)

(72) Inventor: William Shiel, Bartlett, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 1 day.

(21) Appl. No.: 16/715,049

(22) Filed: Dec. 16, 2019

(65) Prior Publication Data

US 2021/0178628 A1 Jun. 17, 2021

(51) Int. Cl.
*B27B 27/02* (2006.01)
*B27B 27/10* (2006.01)

(52) U.S. Cl.
CPC ..... *B27B 27/02* (2013.01); *B27B 27/10* (2013.01)

(58) Field of Classification Search
CPC ..... B27B 27/02; B27B 27/10
See application file for complete search history.

(56) References Cited

U.S. PATENT DOCUMENTS 5,181,446 A * 1/1993 Theising ..... B27B 27/02 83/438
6,450,077 B1 9/2002 Ceroll et al.
6,851,345 B1 * 2/2005 Kennelly ..... B27B 27/02 144/253.5
6,931,779 B1 * 8/2005 Galuppo, Jr. ..... F41G 11/001 42/114
8,789,450 B2 7/2014 Scherl
2006/0201301 A1 * 9/2006 Schwaiger ..... B23D 45/068 83/477.1
2007/0259064 A1 * 11/2007 Mathews ..... E04F 21/06 425/87
2011/0061508 A1 * 3/2011 Scherl ..... B27B 27/02 83/438
2013/0284792 A1 * 10/2013 Ma ..... A61B 1/00087 227/176.1
2014/0174273 A1 * 6/2014 Frolov ..... B27B 27/00 83/440
2015/0183123 A1 * 7/2015 Niichel ..... B23D 59/00 83/418
2019/0202080 A1 7/2019 Frolov et al.

* cited by examiner

*Primary Examiner* — Evan H MacFarlane
*Assistant Examiner* — Fernando A Ayala
(74) *Attorney, Agent, or Firm* — Kelly McGlashen

(57) ABSTRACT

A fence assembly of a saw device includes a fence, a slide mechanism coupled to one end of the fence, and a tensioning mechanism coupled to the other end of the fence. The fence assembly includes a handle that is supported on the slide mechanism via a cam. The handle is rotatable relative to the cam between a first position in which the fence assembly is fixed relative to the rails, and a second position in which the fence assembly is movable relative to the rails. The fence assembly includes a tension member that is coupled at one end to the handle and at the other end to the tensioning mechanism. The cam is rotatable relative to the slide mechanism about a cam rotational axis, and rotation of the cam relative to the cam rotational axis provides an adjustment of a tension force applied by the tension member.

16 Claims, 10 Drawing Sheets

TABLE SAW FENCE WITH TENSION ADJUSTMENT CAM

BACKGROUND

Table saws of various designs include a frame and an upward-facing work surface having an opening through which a blade extends. Table saws may include a movable fence that is supported on rails disposed on opposed sides of the work surface. The fence provides a guide surface against which material to be cut is positioned. During a cutting operation, the material rests on the work surface while sliding along the fence as the material is cut by the saw blade. Since the fence is arranged perpendicular to the work surface and is aligned generally parallel to the blade, the fence enables the table saw to provide cuts that are accurate, straight and reproducible. The fence can be positioned relative to the work surface by sliding the fence along the rails to a desired spacing from the blade, and securing the fence in a desired position using a locking mechanism.

Some fence assemblies include a locking mechanism having front and rear engagement members that engage the rails on both the front and rear sides of the table. Such mechanisms usually include a linkage that transfers mechanical forces from the front side rail to the rear side rail. The linkage may be in the form of a push rod that is advanced toward the rear side of the table and undergoes a compression force when in use. Alternatively, the linkage may be a tension member such as a rod or flexible cable that transmits a pulling force from the front side of the table to the rear side. In many cases, the force applied via the linkage creates a perpendicular friction reaction force to the rear engagement member as well as a counter force to a front engagement member which also produces a perpendicular friction reaction force. These perpendicular friction reaction forces create resistance that prevents movement of the engagement member along the rails, thus locking the fence in position during normal applications, for example, applications including forces below 100 N normal to the fence surface.

Close engagement between the front and rear engagement members and the corresponding front or rear rail is required to achieve accurate and reproducible alignment of the fence relative to the table for every position of the fence along the rails. The closeness of the engagement is determined by the amount of force that is applied through the linkage, for example a tension member, which can be positively or negatively affected by manufacturing tolerance stack up within the fence assembly, cable stretch, wear of assembly components during use, etc. In addition, the tension member and associated mechanisms of a table saw fence are often positioned inside the fence so as to be protected from the saw dust and other environmental damage risks. This internal positioning of the tension member makes it difficult to access the tension member for tension adjustment purposes. For these reasons, it is desirable to be able adjust the amount of tension that is applied through the tension member in order to assure accurate and reproducible fence alignment. In addition, it is desirable to be able to easily access tension adjustment mechanisms from an outside of the fence and the front side of the table.

SUMMARY

In some aspects, a fence assembly is configured to guide a workpiece with respect to a blade of a saw device and is supported for translation along rails relative to a work surface of the saw device. The fence assembly includes a fence including a fence first end, and a fence second end that is opposed to the fence first end, and a slide mechanism coupled to the fence first end and supported on a first one of the rails. The fence assembly includes a tensioning mechanism coupled to the fence second end and supported on a second one of the rails, and a handle that is supported on the slide mechanism via a cam. The handle is rotatable relative to the cam between a first position in which the fence assembly is fixed relative to the rails, and a second position in which the fence assembly is movable relative to the rails. In addition, the fence assembly includes a tension member. The tension member includes a first end that is coupled to the handle, and a second end that is opposed to the first end and coupled to the tensioning mechanism. The cam is rotatable relative to the slide mechanism about a cam rotational axis, and rotation of the cam relative to the cam rotational axis provides an adjustment of a tension force applied by the tension member.

In some embodiments, the tension member is coupled to the handle via a pivot pin, rotation of the cam relative to the cam rotational axis changes a position of the pivot pin relative to the fence first end, and a change in the position of the pivot pin relative to the fence first end changes a tension force applied by the tension member to the tensioning mechanism.

In some embodiments, the handle is rotatable relative to the cam about a handle rotational axis, and the cam rotational axis is parallel to, and spaced apart from, the handle rotational axis.

In some embodiments, the tension member has a first end that is connected to the handle via a pivot pin that defines a tension member connection axis. The handle is rotatable relative to the cam about a handle rotational axis, and the handle rotational axis is parallel to, and spaced apart from, the tension member connection axis.

In some embodiments, the handle is rotatable between the first position in which the tension member is under a first tension force and the slide mechanism and the tensioning mechanism are fixed relative to the rails, and the second position in which the tension member is under a second tension force and the front and rear housings are movable relative to the rails. The second tension force is less than the first tension force.

In some embodiments, the tension member is a rod.

In some embodiments, the cam includes an outer bearing surface that is rotatably supported on a housing of the slide mechanism. In addition, the cam includes an inner bearing surface that rotatably supports the handle, where the inner bearing surface is positioned eccentrically with respect to the outer bearing surface.

In some embodiments, the fence assembly includes a fence tension adjustment mechanism that is configured to adjust a tension force of the tension member. The fence tension adjustment mechanism includes the cam. The cam includes an outer bearing surface that is rotatably supported on a housing of the slide mechanism, and an inner bearing surface that rotatably supports the handle. The inner bearing surface is positioned eccentrically with respect to the outer bearing surface. The fence tension adjustment mechanism includes an adjustment screw that is coupled to the cam and engages the housing. The adjustment screw is configured to adjust a rotational orientation of the cam relative to the housing.

In some embodiments, the cam is rotatable relative to the housing between a cam first rotational orientation in which the tension member has a first tension force and a cam second rotational orientation in which the tension member has a second tension force, and the first tension force is greater than the second tension force.

In some embodiments, the adjustment screw is configured to secure the cam to the housing in a desired cam rotational orientation.

In some embodiments, the adjustment screw rotates the cam relative to the front housing between a cam first rotational orientation in which a tension member connection axis is a first distance from an end of the fence, and a cam second rotational orientation in which the tension member connection axis a second distance from the end of the fence. The first distance is different from the second distance, and the amount of tension provided in the tension member corresponds to a distance of the tension member connection axis from the end of the fence.

In some embodiments, when the handle is in the first position, the handle obstructs access to the adjustment screw and when the handle is in the second position, the handle does not obstruct access to the adjustment screw.

In some embodiments, the cam comprises a first annular member and a second annular member. The second annular member is separable from the first annular member, and the second annular member is keyed to the first annular member so as to rotate in concert with the first annular member.

In some embodiments, the cam comprises a first annular member and a second annular member. The first annular member includes a first inner edge, and a first outer edge that surrounds the first inner edge. The first annular member includes a first handle-facing surface that extends between the first outer edge and the first inner edge, and a first protrusion that protrudes from the first handle-facing surface. The second annular member includes a second inner edge, and a second outer edge that surrounds the second inner edge. The second annular member includes a second handle-facing surface that extends between the second outer edge and the second inner edge, and a second protrusion that protrudes from the second handle-facing surface. The second protrusion includes a groove that receives, and engages with, the first protrusion.

In some embodiments, an adjustment screw is coupled to the cam and engages the slide mechanism. The adjustment screw is configured to adjust a rotational orientation of the cam relative to the slide mechanism.

In some embodiments, the handle comprises a cylindrical axle that protrudes bilaterally from a first end of the handle. The first annular member is disposed on one side of the handle with a first portion of the axle supported on the first inner edge, and the second annular member is disposed on another side of the handle with a second portion of the axle supported on the second inner edge.

In some aspects, a saw device includes a fence assembly that is supported relative to work surface of the saw device via a first rail and a second rail of the saw device. The fence assembly includes a fence, and a slide mechanism that is disposed on a first end of the fence. The slide mechanism includes a housing configured to engage with the first rail. The fence assembly includes a tensioning mechanism disposed on a second end of the fence. The tensioning mechanism is configured to engage with the second rail. The fence assembly includes a handle that is supported on the slide mechanism. The handle is movable relative to the slide mechanism between a first position and a second position. The fence assembly includes a tension member having a first end that is coupled to the handle and a second end that is coupled to the tensioning mechanism. In addition, the fence assembly includes a fence tension adjustment mechanism that is configured to adjust a tension force of the tension member. When the handle is in the first position, a first tension force is applied by the tension member to the tensioning mechanism. When the handle is in the second position, a second tension force is applied by the tension member to the tensioning mechanism. The second tension force is less than the first tension force. The fence tension adjustment mechanism includes a cam that is supported on the slide mechanism so as to be rotatable about a cam rotational axis. The cam is configured to support the handle so that the handle is rotatable about a handle rotational axis that is parallel to, and spaced apart from, the cam rotational axis. The fence tension adjustment mechanism includes an adjustment screw that passes through an opening in the cam and engages the housing. The adjustment screw is configured to adjust a rotational position of the cam relative to the housing.

In some embodiments, a table saw fence assembly includes a linkage that transfers mechanical forces from the front side rail to the rear side rail using tension member such as a rigid rod or a flexible cable to transmit a tensile force between front and rear engagement members. In the illustrated embodiment, the tension member transfers a pulling force from the rail at the front side of the table to the rail at the rear side of the table. At the rear rail, the rear engagement member is a tensioning mechanism that includes a bar that is connected to a top of the fence via a pivot pin, and the tension member engages the bar below the pivot pin and transmits a force to the bar that pulls the bar toward the rear rail. The bar engages rear rail and applies a compressive force to the rear rail, creating the perpendicular friction reaction force that prevents movement of the fence relative to the table top. At the front rail, the front engagement member is a slide mechanism that includes a handle that is pivotably coupled to the slide mechanism via a rotatable cam. The tension member is coupled to the handle via a pivot pin that defines a tension member connection axis. The tension member connection axis is eccentric relative to a rotational axis of the handle, and rotation of the handle results in the tension member being drawn toward the front rail, whereby the transmission member transmits a force to the handle that pulls the bar toward the rear rail. The amount of tension in the tension member can be adjusted using a fence tension adjustment mechanism, which includes the cam which has an internal eccentric pivot. More specifically, a change in the rotational orientation of the cam relative to the slide mechanism results in a change in the position of the tension member connection axis relative to an end of the fence, and therefore an increase or decrease in the effective length of the tension member. An increase or decrease in the effective length of the tension member results in a corresponding increase or decrease in the tension applied to the tensioning and slide mechanisms via the tension member. Cam rotation is achieved using an adjustment screw that is located on the front side of the table saw and thus is easily accessible to the user. This can be compared to some conventional table saws in which the user must walk around to a rear side of the table, reach around the saw or remove the fence to reach an adjustment mechanism. By providing adjustability of a rotational orientation of the cam, the fence tension adjustment mechanism allows fine tuning of the fence locking force. Further advantageously, the adjustment mechanism disclosed herein provides protection from adjustment while under load and while the fence is in position.

BRIEF DESCRIPTION OF THE FIGURES

" In FIG. 5, solid lines are used to show the handle and pivot pin in a first position, and broken lines are used to show the handle and pivot pin in a second position.

DETAILED DESCRIPTION

Figure 1:
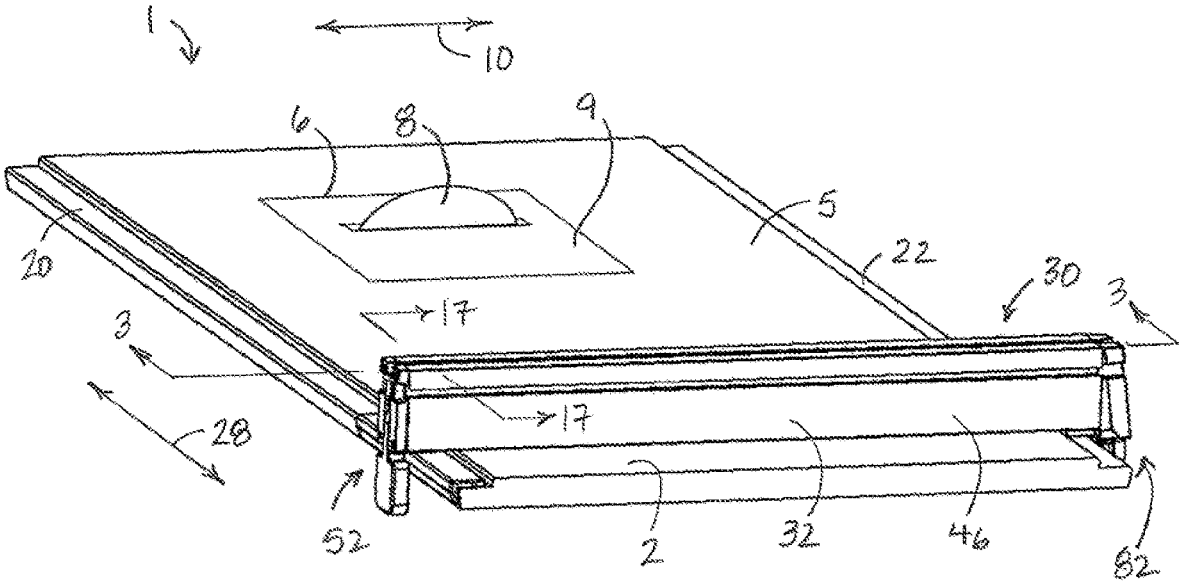
FIG. 1 is a perspective view of a portion of a saw device, showing a saw table top and fence assembly.
Figure 2:
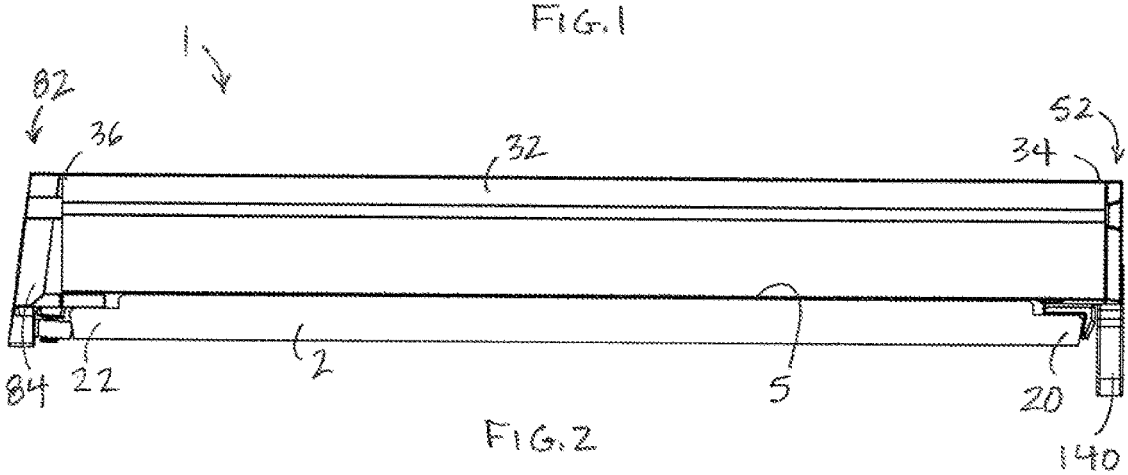
FIG. 2 is a side view of the table top and fence assembly.

Referring to FIGS. 1-7, a saw device 1 includes a table top 2, and a fence assembly 30 that is supported on the saw device 1 so that a fence 32 overlies the table top 2 and extends in parallel to a cutting blade 8 of the saw device 1. The saw device 1 illustrated in the figures is, for example, a table saw, although in other embodiments the saw device 1 may be configured as another type of cutting tool in which a fence assembly is used to position a workpiece (not shown) on a surface relative to the blade 8. The table top 2 is part of a table or cabinet structure (not shown) and defines a planar work surface 5 for supporting the workpiece. The table top 2 includes an opening 6. The blade 8 of the saw device 1, for example a circular saw blade, protrudes through the opening 6, and an insert 9 is disposed in the opening 6 between the blade and the work surface 5. A motor (not shown) is disposed inside cabinet of the saw device 1, and is configured to rotate the blade 8 within the opening 6. The table top 2 has a pair of rails 20, 22 configured to orient the fence assembly 30 relative to the blade when arranged on the table top 2. The fence assembly 30 includes a fence 32, a slide mechanism 52 located at a first end 34 of the fence 32, and a tensioning mechanism 82 located at a second end 36 of the fence 32. The fence assembly 30 includes a handle 140 that pivots between a locked position in which the fence assembly 30 is fixed relative to the table top 2, and a released position in which the fence assembly 30 is free to slide along the rails 20, 22 relative to the table top 2. The handle 140 is supported on the slide mechanism 52 via a cam 200. The fence assembly 30 also includes a linkage in the form of a tension member 120 that extends between the handle 140 and the tensioning mechanism 82. The cam 200 is part of a fence tension adjustment mechanism 190 that is configured to enable adjustment of the tension force of the tension member 120. The fence assembly 30 including the fence tension adjustment mechanism 190 will be described in detail below.

The pair of rails 20, 22 is configured to support the fence assembly 30 relative to the table top 2, and includes a first rail 20 and a second rail 22. The first rail 20 is located on a one edge (for example the front edge) of the table top 2, and the second rail 22 is located on an opposed edge (for example, the rear edge) of the table top 2. In some embodiments, the rails 20, 22 are formed integrally with the table top 2. In other embodiments, the rails 20, 22 are formed as separate parts, each of which is coupled to the table top 2 at an appropriate location. The rails 20, 22 are constructed of a rigid material such as metal or plastic. The first and second rails 20, 22 have the same shape, and the shape of the rails 20, 22 enables the fence assembly 30 to be easily attached to and removed therefrom. The shape of the rails 20, 22 also permits the fence assembly 30 to slide across the work surface 5 of the table top 2 for positioning by a user of the saw device 1.

Figure 3:
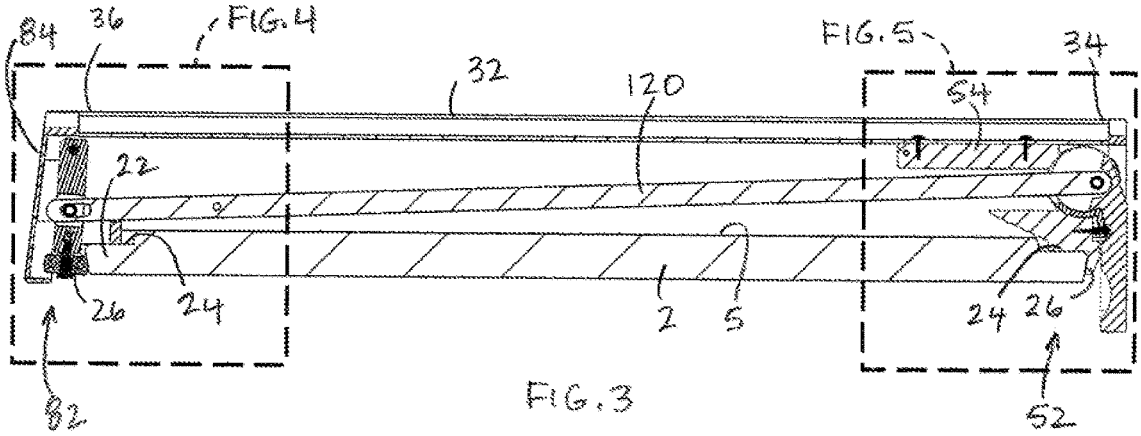
FIG. 3 is a cross-sectional view of the table top and fence assembly as seen along line 3-3 of FIG. 1.

The rails 20, 22 in the embodiment shown have a continuous outer surface such that the outer surface is formed without grooves or cavities that are typical of known rails. The outer surface includes a planar upper surface 24 for supporting a weight of the fence assembly 30 and a planar lateral surface 26 onto which the fence assembly 30 is clamped to attach the fence assembly 30 to the table top 2 (FIG. 3). The upper surface 24 is oriented substantially parallel to the work surface 5 of the table. The lateral surface 26 in some embodiments is oriented substantially normal to the cutting direction 10 although in other embodiments the lateral surface 26 has a negative angle. As used herein, a lateral surface with a negative angle means the lateral surface 26 has a planar orientation that imparts a downward force on a cooperating surface of the fence assembly 30 when the fence assembly 30 is arranged on the rails 20, 22 of the table top 2. The imparted downward force is configured to cause other surfaces of the fence assembly 30 to be urged downward against other surfaces of the table top 2 and the rails 20, 22. An internal region of the rails 20, 22 can be solid (shown), hollow or include any structure that improves the manufacturability, strength, and/or durability of the rails. The rails 20, 22 traverse the width of the table top 2 and define a guide axis 28 that is substantially perpendicular to the cutting direction 10 of the blade 8. The fence assembly 30 is positionable relative to the blade 8 along the guide axis 28.

The fence 32 (FIG. 7) is configured to guide the workpiece on the table top 2 and locate the slide mechanism 52 and the tensioning mechanism 82 relative to one another. The fence 32 is formed of a channel member or profile that in some embodiments defines an interior space for accommodating or positioning other elements of the fence assembly. For example, in some embodiments, the fence is a hollow aluminum extrusion. The fence 32 includes side portions 44, 46. The side portion 44 facing the blade 8 defines a substantially planar guiding surface for guiding the workpiece. When the fence assembly 30 is accurately positioned with respect to the blade 8, the side portion 44 provides a planar guiding surface that is substantially parallel with the cutting direction 10 of the blade to provide for precise cutting of the workpiece. In use, the workpiece rests on the table work surface 5 while abutting the guiding surface, for example side portion 44. The workpiece is cut by advancing the workpiece against the blade 8 including sliding the workpiece over the table work surface 5 and along the side portion 44.

Referring to FIGS. 4 and 8-10, the tensioning mechanism 82 cooperates with the slide mechanism 52 and handle 140 to apply a tension force to the tension member 120, which results in the fence assembly 30 being clamped to the table top 2. The tensioning mechanism 82 includes a rear housing 84 that is fixed to the fence second end 36, and a bar 100 that is pivotally attached at a first end 102 thereof to the rear housing 84 via a bar pivot pin 108. In addition, the tensioning mechanism includes a wheel 114 that is rotatably secured to a second end 104 of the bar 100, where the second end 104 is opposed to the bar first end 102.

The bar 100 is a rigid structure having a rectangular cross section, and also includes a rod opening 110 that receives the tension member 120. The rod opening 110 is disposed generally midway between the bar first and second ends 102, 104. The tension member 120 is coupled to the bar 100 via a pivot pin 109 that extends through the bar 100 at a location corresponding to the rod opening 110.

Figure 4:
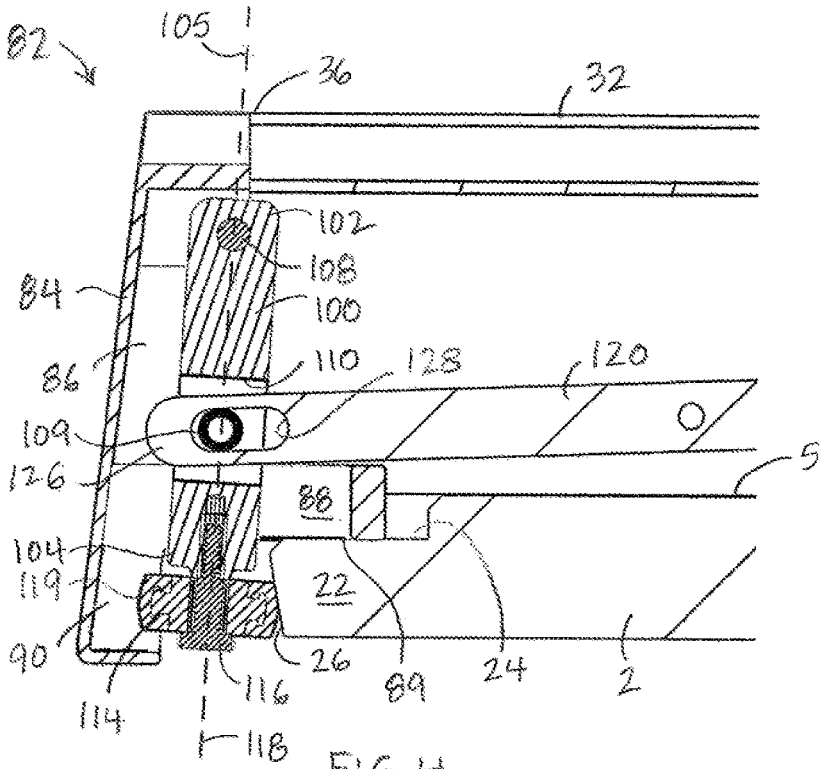
FIG. 4 is an enlarged view of the portion of FIG. 3 enclosed by broken lines and labeled "FIG. 4."

The wheel 114 is secured to the bar second end 104 so as to rotate about a wheel rotational axis 118 provided by a fastener 116 threaded into the bar 100. The wheel rotational axis 118 is parallel to a longitudinal axis 105 of the bar 100, where the bar longitudinal axis 105 extends between the bar first and second ends 102, 104. In this configuration, the wheel 114 is oriented for rolling contact with the lateral surface 26 of the rail 22 when the fence assembly 30 is moved along the guide axis 28. As illustrated in FIG. 4, the wheel 114 has a spherical profile 119 when viewed in a plane passing through and aligned with the wheel rotation axis 118. The spherical profile 119 allows freedom in the angular orientation of the wheel rotation axis 118 relative to the contact angle of rails 20, 22 so as to achieve linear rolling during movement of the fence assembly 30 along the guide axis 28.

The rear housing 84 is configured to cap the rear end face 39 of the fence 32. The rear housing 84 includes a cap portion 86 that closes the rear end face 39 of the fence 32, and a guide block portion 88 that protrudes from the cap portion 86 toward the table top 2 and is configured to be supported on, and slide relative to, the upper surface 24 of the rear rail 22. In addition, the rear housing 84 includes a housing stop portion 90 that depends from the cap portion 86. The housing stop portion 90 faces, and is spaced apart from, the rear rail lateral surface 26. In addition, the wheel 114 is disposed between the housing stop portion 90 and the rear lateral surface 26. Although there is sufficient space between the wheel 114 and the housing stop portion 90 for the wheel 114 to rotate freely about the wheel rotational axis 118, the housing stop portion 90 limits the extent of movement of the wheel 114 away from the rear lateral surface 26. The rear housing 84 includes a central through opening 92 that is defined within both the cap portion 86 and the guide block portion 88. The central through opening 92 is shaped and dimensioned to permit the bar 100 to pivot through an arc length defined between the rear rail lateral surface 26 and the housing stop portion 90.

The guide block portion 88 of the rear housing 84 is located proximate to the fence second end 36 on a lower portion of the fence 32. The guide block portion 88 protrudes inwardly from the cap portion 86, and has a planar lower surface 89 that is oriented substantially parallel to the upper surface 24 of the rail 22. In the illustrated embodiment, the guide block portion 88 is configured to support a weight of the fence assembly 30 on the rail 22 and provide a low resistance to motion when the fence assembly 30 is moved along the guide axis 28. In other embodiments, a lower surface of the fence 32 may support the weight of the fence assembly 30 across the table top 2 and provides a low resistance to motion when the fence assembly 30 is moved along the guide axis 28.

Referring to FIGS. 5 and 11-16, the slide mechanism 52 includes a front housing 54 that is disposed at the fence first end 34, and a cap 51 that closes the front end face 38 of the fence 32. The cap 51 includes an elongated slot 53 that receives, and permits rotational movement of the handle 140 relative to the cap 51 and the slide mechanism 52.

Figure 16:
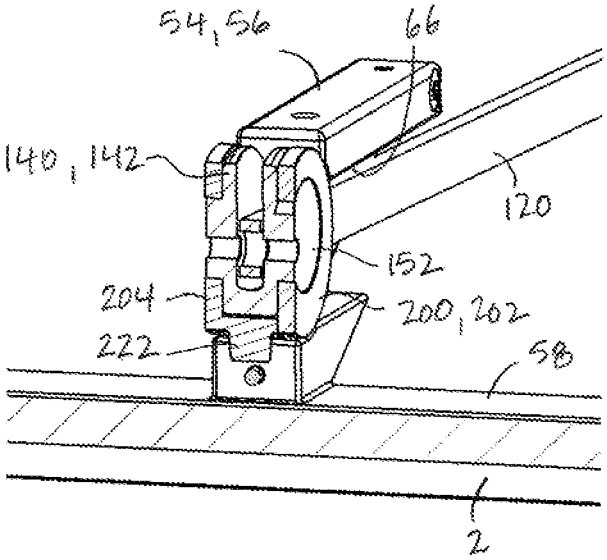
FIG. 16 is a cross-sectional view of the slide assembly as seen along line 16-16 of FIG. 11.
Figure 17:
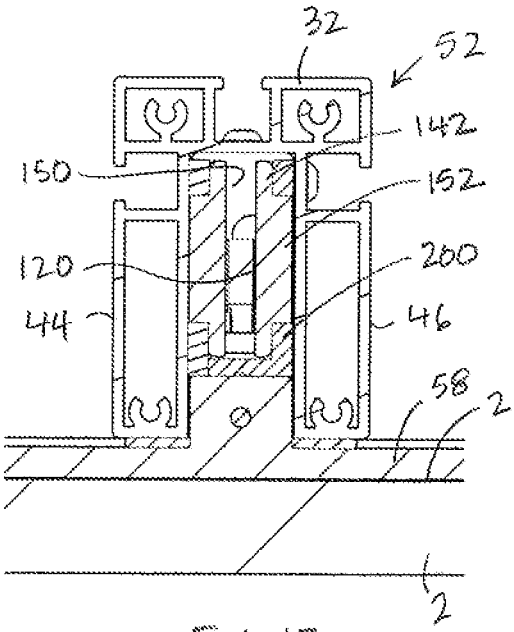
FIG. 17 is a cross-sectional view of the fence assembly as seen along line 17-17 of FIG. 1.
Figure 18:
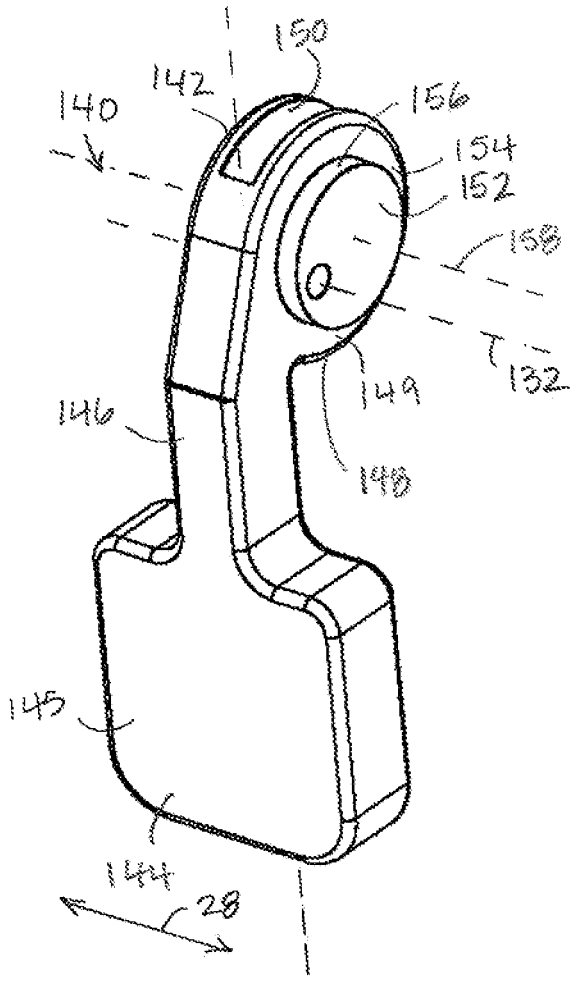
FIG. 18 is front perspective view of the handle.
Figure 19:
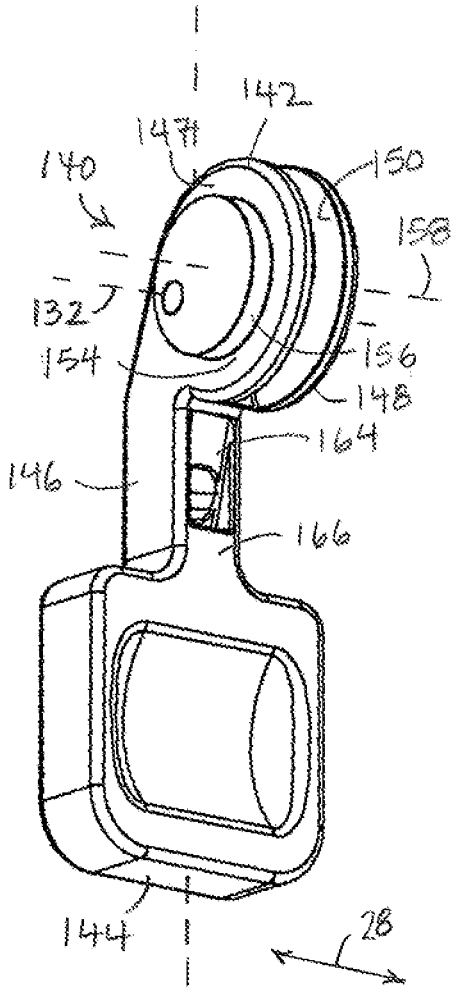
FIG. 19 is a rear perspective view of the handle.
Figure 20:
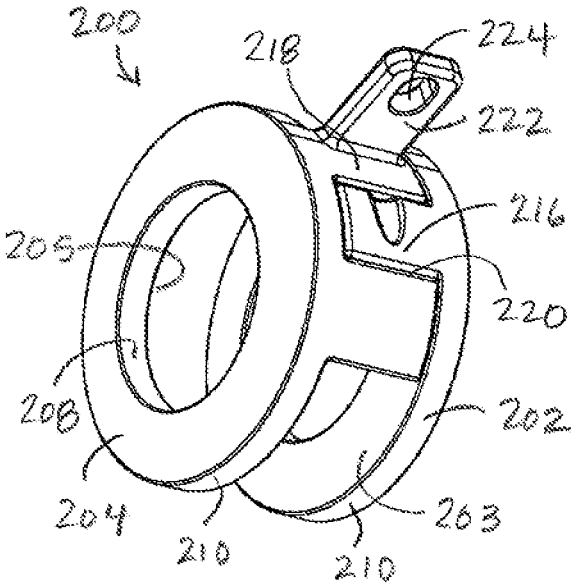
FIG. 20 is first perspective view of the cam.
Figure 21:
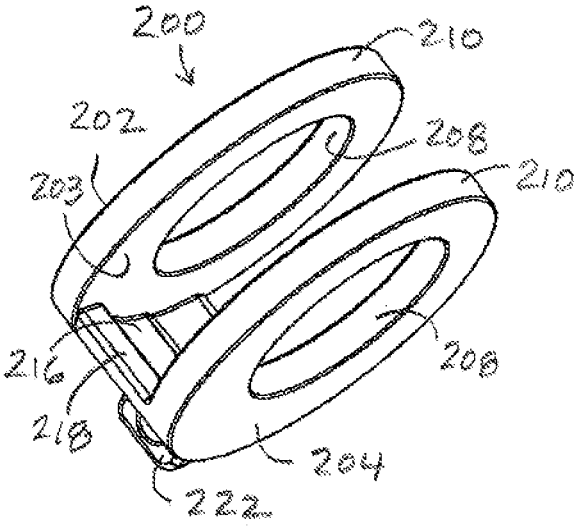
FIG. 21 is a second perspective view of the cam.
Figure 22:
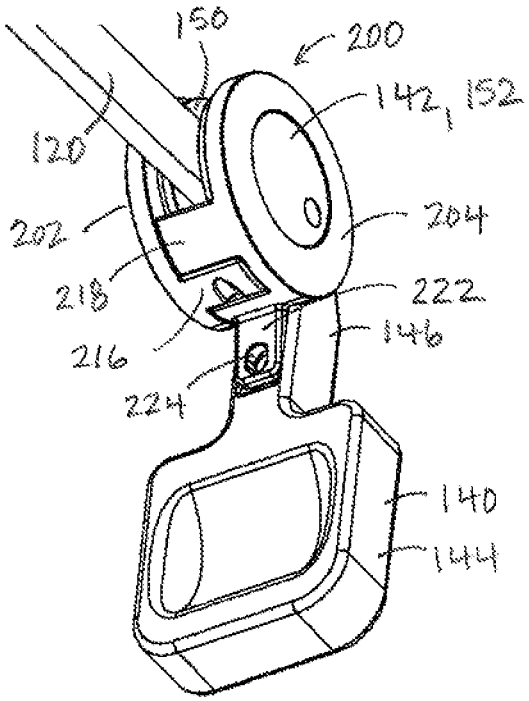
FIG. 22 is rear perspective view of the cam assembled on the handle.
Figure 23:
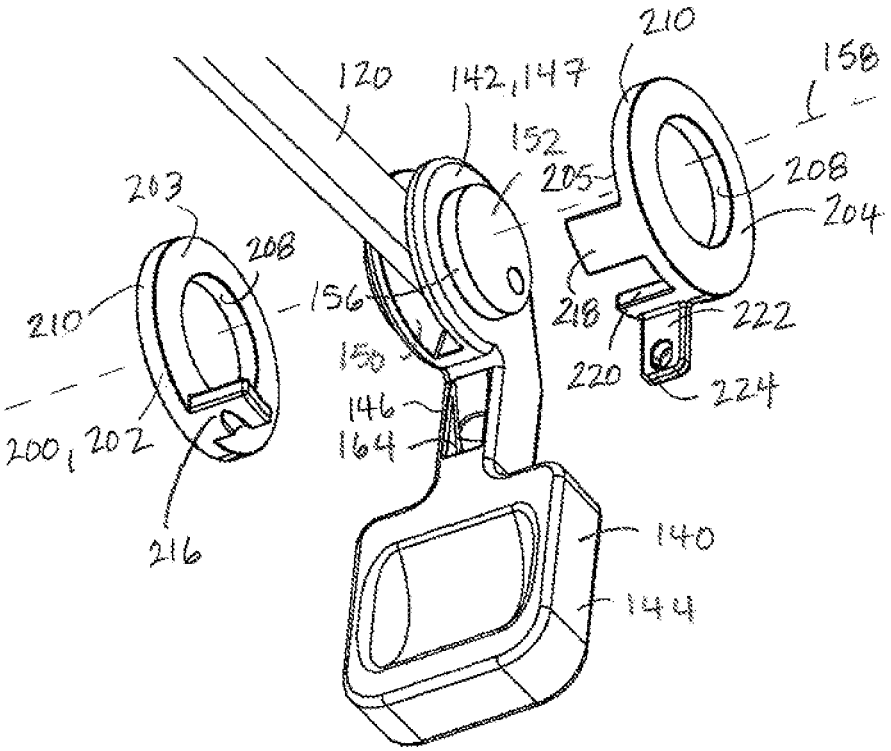
FIG. 23 is an exploded rear perspective view of cam assembled on the handle.

The front housing 54 is a rigid structure that has a T-shaped profile when viewed facing the table top 2. The front housing 54 includes a body portion 56 and a flange portion 58. The body portion 56 is elongated in a direction parallel to the cutting direction 10, and is disposed in the hollow interior 48 the fence 32. In particular, the body portion 56 is shaped and dimensioned to be received in the fence hollow interior 48 in a clearance fit, and is coupled to the first end 34 of the fence 32 using fasteners 65. In addition, a side surface of the body portion 56 includes a groove 66 that extends in a direction parallel to cutting direction 10 and opens at each end 67, 68 of the body portion 56. The groove 66 provides a passageway that receives the tension member 120 (FIG. 16). The end 68 of the body portion closest to the front rail 20 includes a circular cutout 64 that rotatably supports a fence tension adjustment mechanism 190, as discussed further below.

The flange portion 58 is disposed at an end 68 of the body portion 56 that is closest to the fence first end 34. The flange portion 58 extends integrally from a table top-facing surface of the body portion 56, and extends bi-laterally from the body portion 56 along the guide axis 28. The flange portion 58 includes rail-facing surfaces 69, 70 that are shaped and dimensioned to confront and engage with the upper surface 24 and the lateral surface 26 of the first rail 20. For example, the flange portion 58 has a planar lower surface 69 and a planar lateral surface 70 that adjoins the lower surface 69. The lower surface 69 of the flange portion 58 is oriented substantially parallel to the upper surface 24 of the rails 20, 22. The orientation of the lateral surface 70 of the flange portion 58 corresponds substantially to the orientation of the lateral surface 26 of the rails 20, 22. In use, when the handle 140 is in a locked position, the body portion 56 and the flange portion 58 are fixed with respect to the fence 32 to establish alignment of the fence 32 relative to the blade via the slide mechanism 52.

The rail-facing surfaces 69, 70 each include a pair of slide contacts 60 that are spaced bilaterally from the fence 32 along the guide axis 28. In the illustrated embodiment, the slide contacts 60 are positioned proximate to ends of each of the rail-facing surfaces 69, 70. However, in other embodiments the slide contacts 60 may be positioned inward from the ends of each of the rail-facing surfaces 69, 70, or in other locations appropriate for facilitating a gliding motion of the flange portion 58 along the first rail 20.

In the illustrated embodiment, the slide contacts 60 are formed separately from the flange portion 58 and attached directly to the flange portion 58 by a fastener, adhesive, or the like. The slide contacts 60 can be formed from a polymer material such as ultra-high-molecular-weight polyethylene (UHMW) or Delrin®. In other embodiments, the slide contacts 60 are defined by the flange portion 58 such that the slide contacts are integrally formed by the material of the flange portion 58. The pairs of slide contacts 60 each establish two distinct contact points between the fence assembly 30 and a corresponding rail 20, 22 of the table top 2 to facilitate alignment of the fence assembly 30 relative to the blade. The slide mechanism 52 is positioned at a front of the table top 2 such that two pair of slide contacts 60 cooperate with the rail 20 located closest to the user of the saw device 1.

Figure 5:
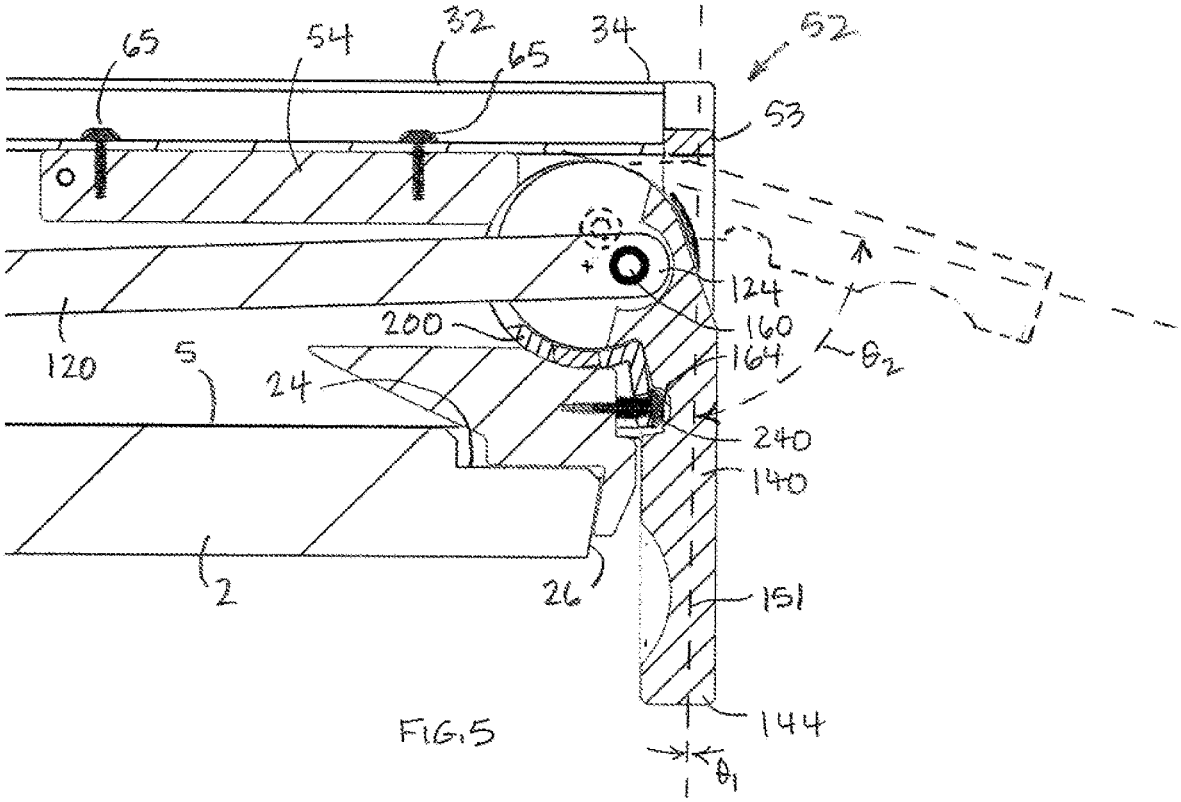
FIG. 5 is an enlarged view of the portion of FIG. 3 enclosed by broken lines and labeled "FIG. 5.
Figure 6:
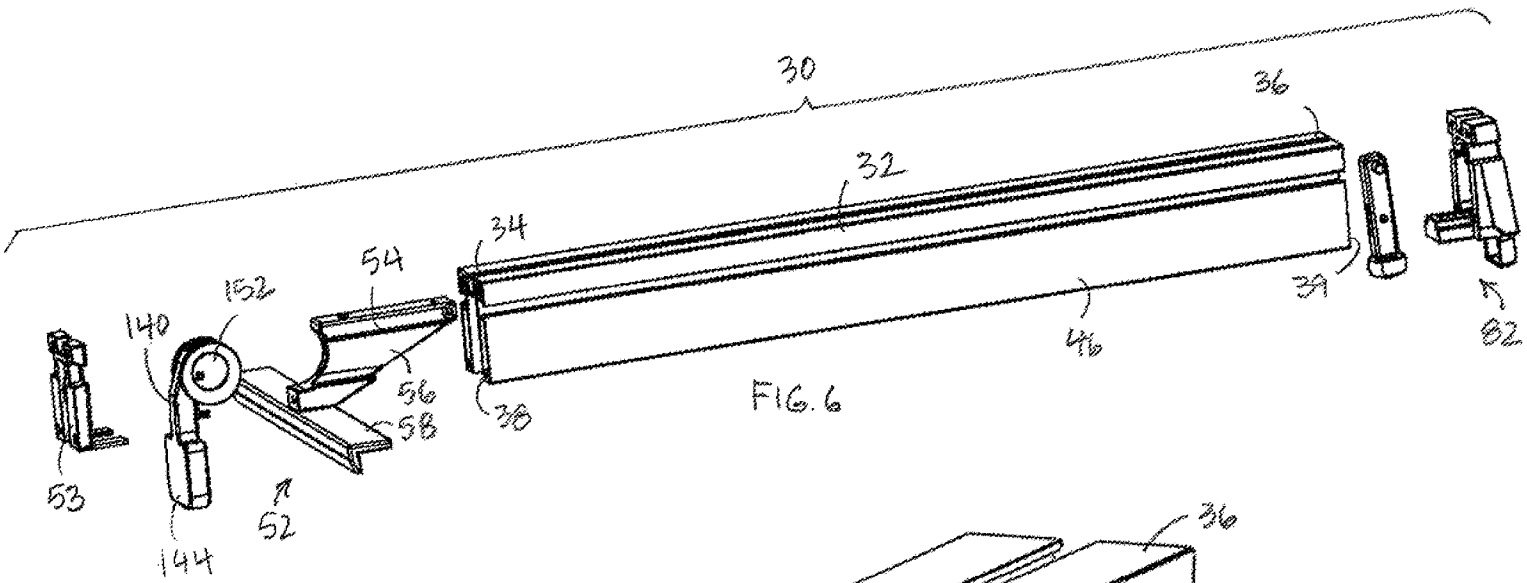
FIG. 6 is an exploded perspective view of the fence assembly.
Figure 7:
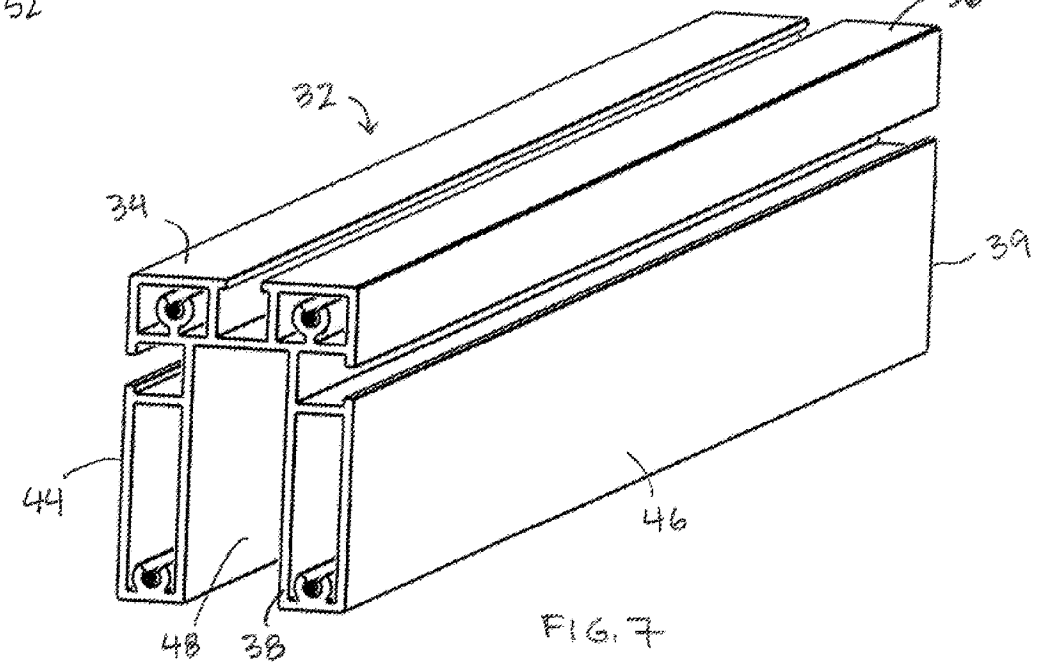
FIG. 7 is a perspective view of the fence isolated from the fence assembly.
Figure 10:
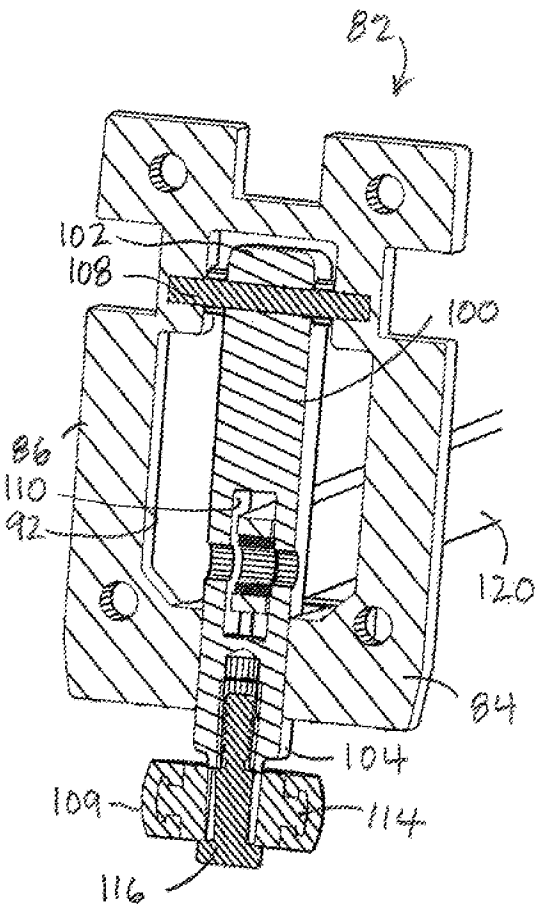
FIG. 10 is a cross-sectional view of the tensioning mechanism of the fence assembly as seen along line 10-10 of FIG. 8.
Figure 9:
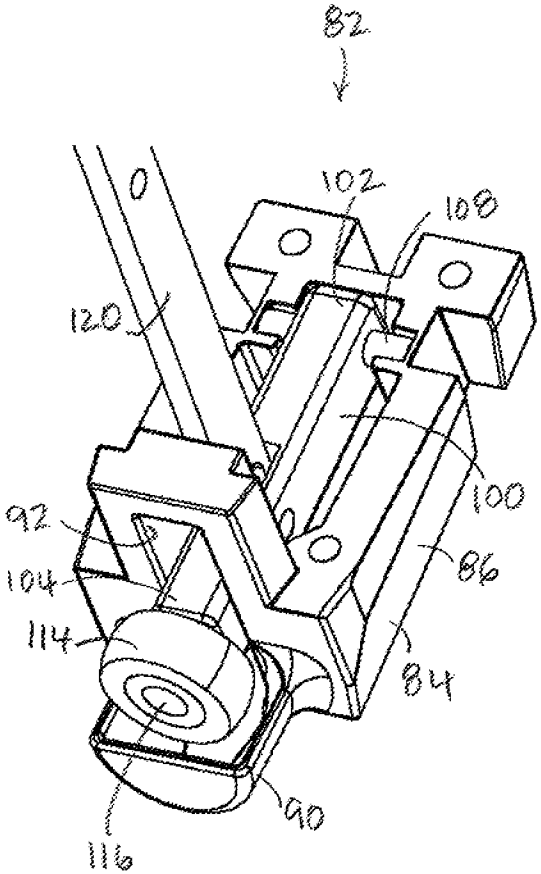
FIG. 9 is a bottom perspective view of the tensioning mechanism of the fence assembly.
Figure 8:
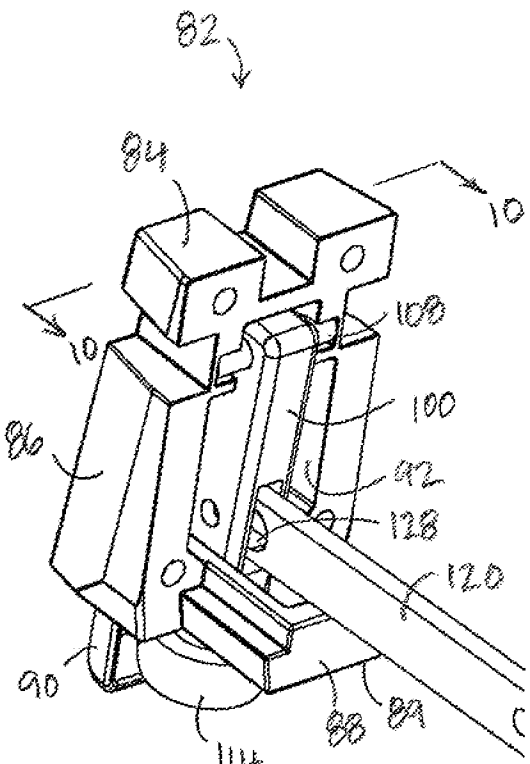
FIG. 8 is a top perspective view of the tensioning mechanism of the fence assembly.
Figure 11:
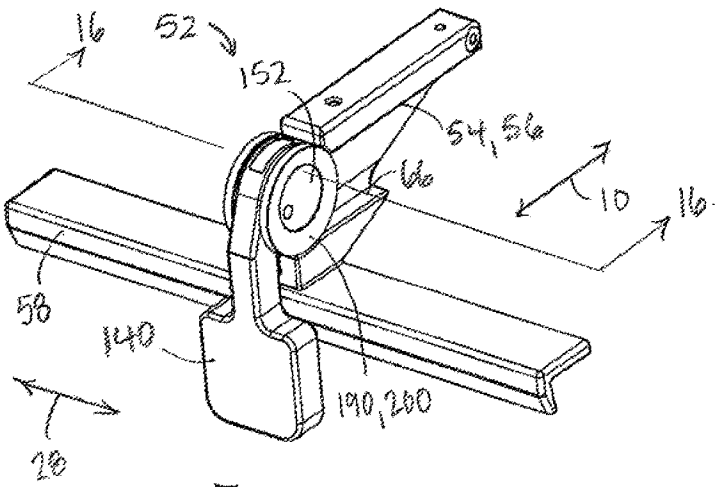
FIG. 11 is a front perspective view of the slide mechanism of the fence assembly.
Figure 12:
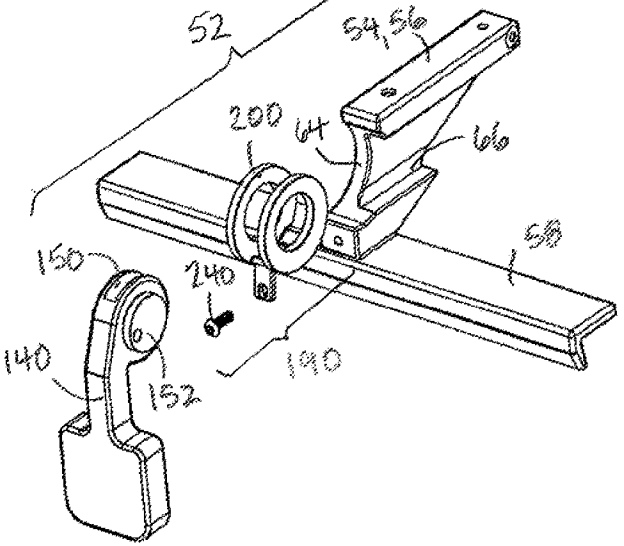
FIG. 12 is an exploded front perspective view of the slide mechanism of the fence assembly.
Figure 13:
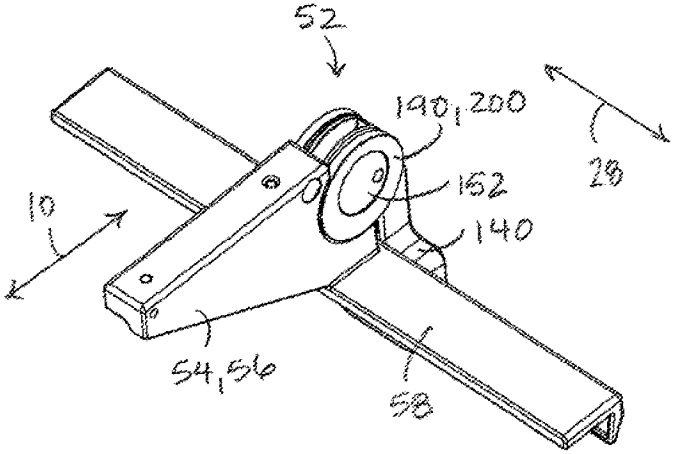
FIG. 13 is a rear perspective view of the slide mechanism of the fence assembly.
Figure 14:
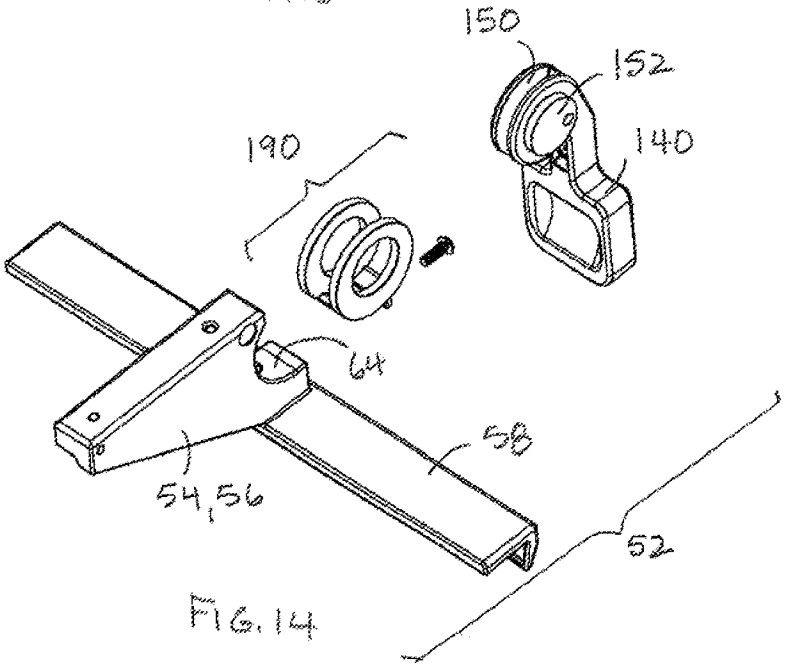
FIG. 14 is an exploded rear perspective view of the slide mechanism of the fence assembly.
Figure 15:
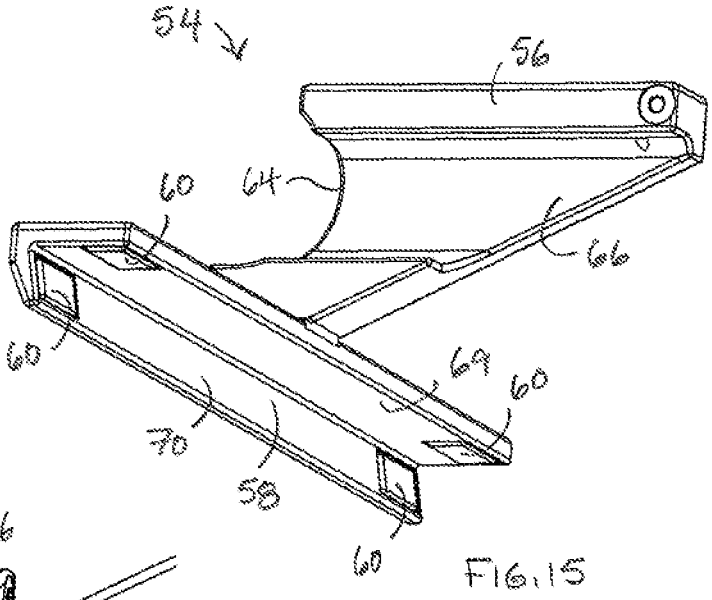
FIG. 15 is another rear perspective view of the slide mechanism of the fence assembly.

Referring to FIGS. 3-5, the tension member 120 is an elongated rigid rod that operatively couples the slide mechanism 52 to the tensioning mechanism 82. In the illustrated embodiment, the tension member 120 has a rectangular cross sectional shape, and is uniform in dimension along its length. The tension member 120 has a first end 124 that is connected the handle 140 via a pivot pin 160. The pivot pin 160 defines an axis of rotation of the tension member first end 124 relative to the handle 140. This axis of rotation is referred to hereafter as the tension member connection axis 132, as discussed further below. The tension member 120 has a second end 126 that is opposed to the first end 124. The tension member second end 126 includes an elongated through hole (e.g., a slot) 128 that receives the pivot pin 109, whereby the tension member second end 126 is pivotably coupled to the bar 100. In use, the tension member 120 is disposed within the fence 32 and transmits a tension force from the slide mechanism 52 to the tensioning mechanism 82 in certain positions of the handle 140, as discussed further below.

Referring to FIGS. 5, 18-19 and 22-23, the handle 140 is supported on the front housing 54 via the cam 200. The handle 140 includes a handle first end 142 that is coupled to the tension member 120, a handle second end 144 that is opposed to the first end 142, and a handle midportion 146 that is disposed between the handle first and second ends 142, 144. When the handle 140 is viewed in a direction perpendicular to the guide axis 28, the handle second end 144 is wide relative to the handle first end 142 and the handle midportion 146. The enlarged handle second end 144 is grasped by the user during operation of the handle 140, and has a rectangular shape including a planer outer surface 145 that is generally perpendicular to the fence side portions 44, 46. The handle 140 includes a longitudinal axis 151 that extends through the handle second end 144 and the handle midportion 146 and is parallel to the outer surface 145 of the handle second end 144.

When the handle 140 is viewed in a direction parallel to the guide axis 28, it can be seen that the handle first end 142 is offset toward the fence 32 relative to the handle midportion and second ends 146, 144. The handle first end 142 has a disk shape with planar side surfaces 147, 149 that are generally parallel to the fence side portions 44, 46. Thus, the handle first end 142 has a circular profile 148 when the handle 140 is viewed in a direction parallel to the guide axis 28. In addition, the handle first end 142 includes a channel 150 that opens along the circular profile 148. The channel 150 opens facing the fence 32 and extends in a direction perpendicular to the guide axis 28. The channel 150 is shaped and dimensioned to receive the tension member first end 124 and permit the tension member 120 to rotate freely relative to the handle 140 regardless of the position of the handle 140. To this end, the tension member 120 is secured to the handle first end 142 via the pivot pin 160 that bridges the channel 150.

The handle 140 includes a cylindrical axle 152 that extends integrally, and bi-laterally, from the side surfaces 147, 149 of the handle first end 142. The axle 152 is centered within the circular profile 148 defined by the handle first end 142 (e.g., the profile of the axle 152 is concentric with the profile of the handle first end 142). The axle 152 has an axle diameter d1 that is less than the diameter d2 of the handle first end 142, whereby a shoulder 154 is provided on the handle first end 142 that receives the cam 200. The axle 152 has an outer or circumferential surface 156 that is supported on inner bearing surfaces 208 of the cam 200 for rotation about a handle rotational axis 158, as discussed below. The handle rotational axis 158 is offset from the tension member connection axis 132 defined by the pivot pin 160. In the illustrated embodiment, the rotational axis 158 is closer to the fence than the tension member connection axis 132.

The handle 140 also includes a recess 164 that is formed on a fence-facing surface 166 of the handle midportion 146. The recess 164 is shaped and dimensioned to receive a catch plate 222 of the cam 200, as discussed below. In addition, a blind opening 168 is provided in the recess 164. The blind opening 168 is configured to engage with an adjustment screw 240, as discussed below.

The handle 140 is operatively coupled to the front housing 54 of the slide mechanism 52 via the cam 200 so that the handle 140 is rotatable about the handle rotational axis 158 relative to the front housing 54 between a first, locked position (shown in FIG. 5 using solid lines) and a second, released position (shown in FIG. 5 using broken lines).

In the first position, the handle longitudinal axis 151 is oriented at a first angle θ1 relative to the front housing 54. In the illustrated embodiment, when the handle 140 is at the first angle θ1 relative to the front housing 54, the handle longitudinal axis 151 is oriented substantially vertically, where the term "substantially vertically" refers to the first angle θ1 being within plus or minus (+/−) five degrees of vertical.

In the first position, the tension member connection axis 132 is located outward (e.g., further from the fence 32) relative to the handle rotational axis 158.

In the first position, a first tension force is applied by the tension member 120 to the bar 100 of the tensioning mechanism 82. The first tension force is sufficient to draw the wheel 114 against the rear rail 22. In addition, the tension member 120 subjects the slide mechanism 52 to a counter or reaction force in which the flange portion 58 is drawn against the front rail 20 and generates the perpendicular friction force, whereby the tensioning mechanism 82 generates a clamping force on the table top 2 between the wheel 114 and the pairs of slide contacts 60. The clamping force exerts a sufficient force to fix a position of the fence assembly 30 along the guide axis 28. In some embodiments, the clamping force is a "sufficient force" if it resists movement of the fence assembly 30 when a side load of at least 30 pounds is applied to the fence assembly 30 in the direction of the guide axis 28.

In the second position, the handle longitudinal axis 151 is oriented at a second angle θ2 relative to the front housing 54. When the handle 140 is at the second angle θ2 relative to the front housing 54, the handle longitudinal axis 151 is oriented in a range of 45 to 90 degrees relative to the vertical. In the illustrated embodiment, for example, the second angle t2 is about 70 degrees from the vertical.

As the handle 140 is rotated from the first position to the second position, the tension member connection axis 132 moves generally upward (e.g., away from the table top 2) and inward (e.g., toward the fence 32). In the illustrated embodiment, when the handle 140 is in the second position, the tension member connection axis 132 and the handle rotational axis 158 are located at about the same distance from the fence 32. As result of moving the tension member connection axis 132 closer to the fence 32, the tension force applied by the tension member 120 to the tensioning and slide mechanisms is reduced relative to the tension force applied in the first position. More specifically, in the second position, the tension force is sufficiently reduced to permit the fence assembly to easily move along the rails 20, 22 whereby the position of the fence assembly 30 relative to the table top 2 can be adjusted.

Referring to FIGS. 5, 12, 14 and 20-28, the fence assembly 30 includes the fence tension adjustment mechanism 190 configured to permit a user to finely adjust the fence locking force (e.g., the amount of tension force applied by the tension member 120 to the slide mechanism 52 and the tensioning mechanism 82) when the handle is in the first position. Advantageously, the fence tension adjustment mechanism 190 allows the user to compensate for cable stretch, wear in or excessive tension due, for example, to the stack up of tolerances during manufacturing. The fence tension adjustment mechanism 190 adjusts the effective length of the tension member 120, by either increasing or decreasing the effective length. This adjustability allows the user to achieve an optimal balance between the locked fence resistive force and the force required to be applied to the handle 140 by a user to change the handle position.

The fence tension adjustment mechanism 190 includes a cam 200 that supports the handle 140 for rotation relative to the front housing 54, and an adjustment screw 240 that secures the cam 200 to the front housing.

The cam 200 is an assembly of a first annular member 202 and a second annular member 204. The first annular member 202 supports the axle 152 on one side surface 147 of the handle first end 142, and the second annular member 204 supports the axle 152 on the other side surface 149 of the handle first end 142. The first annular member 202 is separable from the second annular member 204 to allow assembly with the axle 152, and in use the first annular member 202 is keyed to the second annular member 204 so as to rotate in concert with the second annular member 204.

Each of the first and second annular members 202, 204 includes an inner edge that serves as an inner bearing surface 208 that rotatably supports the axle outer surface 156. Each of the first and second annular members 202, 204 includes an outer edge that serves as an outer bearing surface 210 that is rotatably supported on the circular cut out 64 of the front housing 54. The outer bearing surface 210 has a circular profile, and is centered on a rotational axis 212 of the cam 200. The inner bearing surface 208 has a circular profile, is eccentric with respect to the outer bearing surface 210, and is concentric with the handle rotational axis 158.

The first annular member 202 includes a planar first handle-facing surface 203 that extends between the inner and outer bearing surfaces 208, 210 of the first annular member 202. When the cam 200 is assembled with the handle 140, the first handle-facing surface 203 abuts the first side surface 147 of the handle first end 142. In addition, the first annular member 202 includes a first protrusion 216 that protrudes from the first handle-facing surface 203 toward the second annular member 204. The first protrusion 216 has an outward-facing surface that is curved and flush with respect to a portion of the outer bearing surface 210 of the first annular member 202.

Likewise, the second annular member 204 includes a planar second handle-facing surface 205 that extends between the inner and outer bearing surfaces 208, 210 of the second annular member 204. When the cam 200 is assembled with the handle 140, the second handle-facing surface 205 abuts the second side surface 149 of the handle first end 142. In addition, the second annular member 204 includes a second protrusion 218 that protrudes from the second handle-facing surface 205 toward the first annular member 202. The second protrusion 218 has an outward-facing surface that is curved and flush with respect to a portion of the outer bearing surface 210 of the second annular member 204.

The second protrusion 218 includes a cut out 200 that opens toward the first annular member 202, and that is shaped and dimensioned to receive the first protrusion 216. When the cam 200 is assembled with the handle 140, the first protrusion is disposed in the cut out 220, whereby the first annular member 202 is keyed to the second annular member 204. The second protrusion 218 also includes a depending leg that serves as a catch plate 222. The catch plate 222 extends radially outward (e.g., away from the handle first end 142) from the second protrusion 218. When the cam 200 is assembled with the handle 140, the catch plate 222 faces the handle mid portion 146, and is aligned with the recess 164. The catch plate 222 includes a through opening 224 that is configured to receive the adjustment screw 240 therethrough. More specifically, the through opening 224 has a sliding engagement with the adjustment screw 240 so that the catch plate 222 moves in concert with an axial position of the adjustment screw 240.

The cam 200 is formed of a low friction material to facilitate rotation of the cam 200 with respect to the front housing 54, and to facilitate rotation of the axle 152 relative to the cam inner bearing surfaces 208, 208. For example, in some embodiments, the cam 200 is formed of ultra high molecular weight (UHMW) polyethylene (PE).

The adjustment screw 240 includes a head 242 and a threaded shank 244 that extends from one end of the head 242. The threads of the shank 244 are shaped and dimensioned to engage with corresponding threads provided in the blind opening 168 that is located in the recess 164 of the handle midportion 146. At this location, the adjustment screw 240 is located below the cam axis of rotation 212.

The adjustment screw 240 is configured to adjust a rotational orientation of the cam 200 relative to the front housing 54. In particular, adjustment of the position of the adjustment screw 240 relative to the front housing 54 (for example, via rotation of the adjustment screw 240 relative to the opening 168) results in movement of the catch plate 222 relative to the front housing 54. In turn, the movement of the catch plate 222 results in a change in the rotational orientation of the cam 200 relative to the front housing 54. In this regard, the cam 200 is rotatable relative to the front housing 54 via adjustment of the adjustment screw 240. Because the handle axle 152 is supported eccentrically on the cam 200 inner bearing surface 208 relative to the cam rotational axis 212, the change in the rotational orientation of the cam 200 changes a position of the tension member connection axis 132 relative to the fence 32. In other words, the change in the rotational orientation of the cam 200 results in an increase or decrease in the effective length of the tension member 120.

Figure 27:
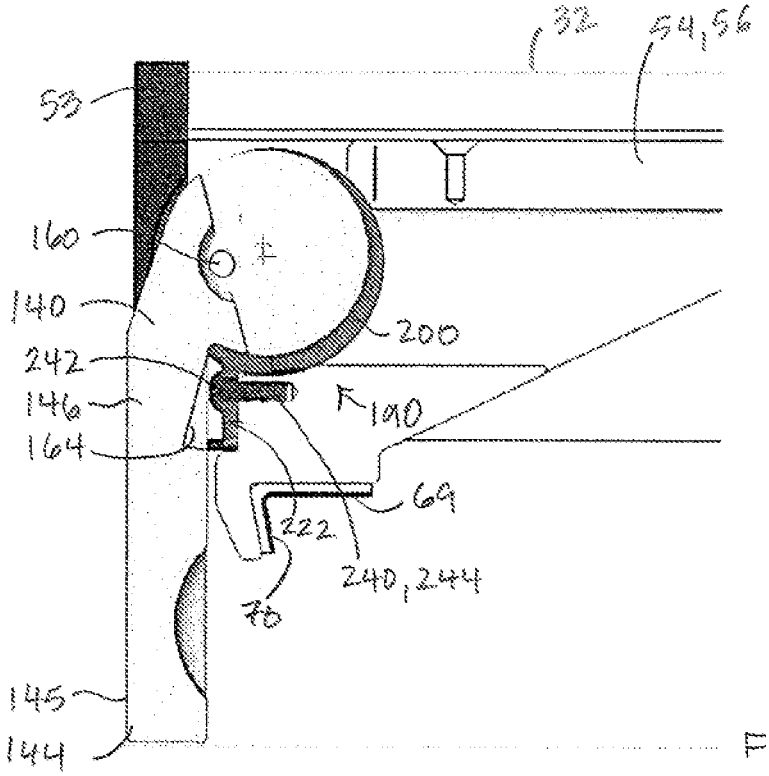
FIG. 27 is a side view of a portion of the fence assembly with the fence omitted, showing the fence tension adjustment mechanism in a first position.

Decreasing the effective length of the tension member 120 results in an increase in the tension force applied by the tension member 120. This is achieved by rotating the adjustment screw 240 into the threaded opening 168, which moves the catch plate 222 closer to the front housing 54 (FIG. 27). This increased tension force correlates to an increased locking force at the rear of the fence assembly 30 when the handle 140 is in the first, locked position. The increased tension force increases the effective resistance on the handle 140 and requires an increased input force from the user to operate the handle 140. This adjustment can be made to account for cable stretch, wear-in, etc. within the fence assembly 30.

Figure 24:
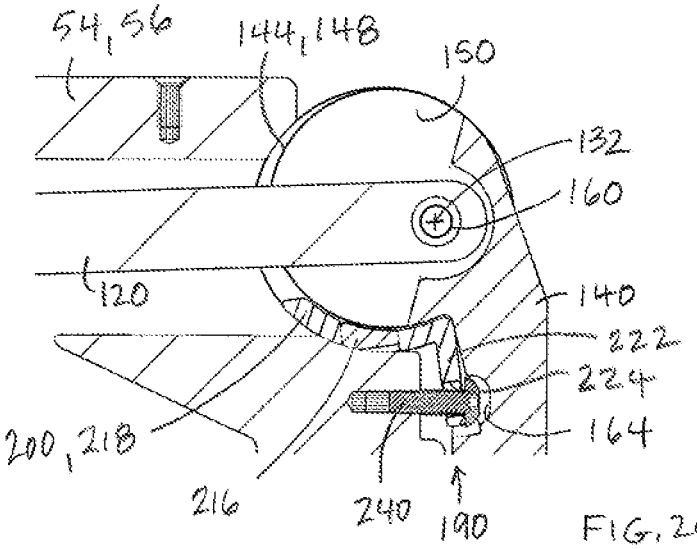
FIG. 24 is a cross sectional view of a portion of the fence assembly with the fence and slide mechanism cover omitted.
Figure 25:
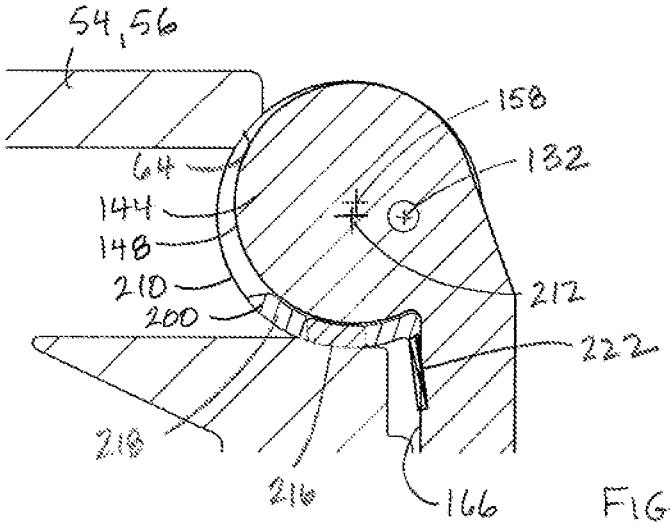
FIG. 25 is another cross sectional view of a portion of the fence assembly with the fence and slide mechanism cover omitted.
Figure 26:
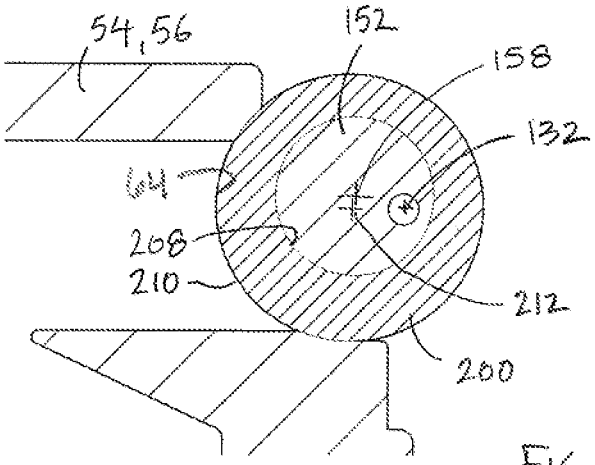
FIG. 26 is yet another cross sectional view of a portion of the fence assembly with the fence and slide mechanism cover omitted.
Figure 28:
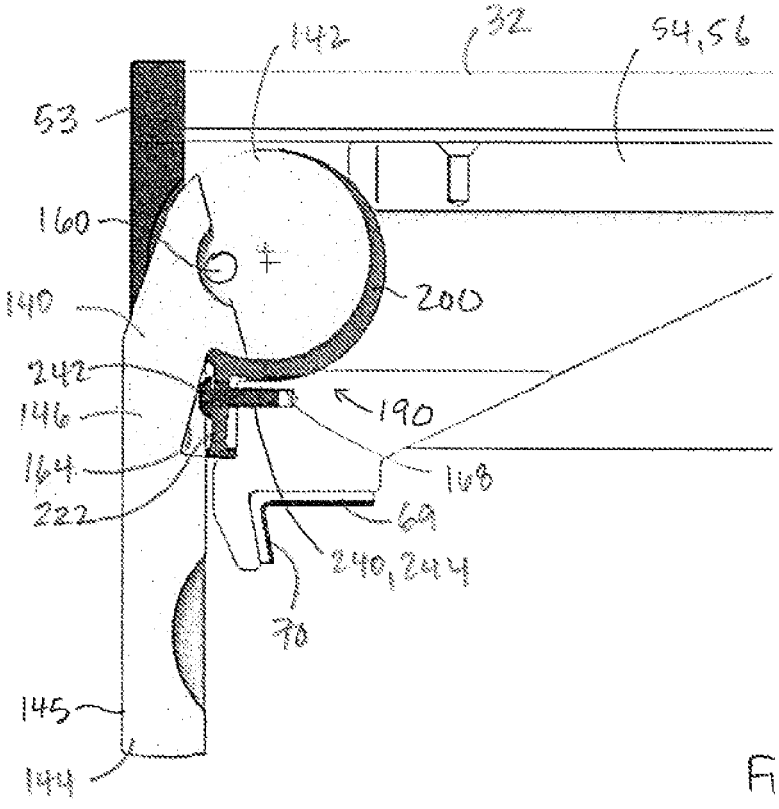
FIG. 28 is a side view of a portion of the fence assembly with the fence omitted, showing the fence tension adjustment mechanism in a second position.

Increasing the effective length of the tension member 120 has the opposite effect. That is, increased effective tension length decreases the tension force applied by the tension member 120. This is achieved by rotating the adjustment screw 240 out of the threaded opening 168, which moves the catch plate 222 away from the front housing 54 (FIGS. 24 and 28). This results in a decreased locking force at the rear rail 22, but also results in a decreased input force from the user to operate the handle 140. This adjustment may be made, for example, if a tensioning adjustment is overdone and resulting force required to operate the handle 140 becomes unreasonable for the user.

The cam 200 is able to rotate in the fence assembly 30 in a range of at least 5 degrees and no more than 90 degrees. The tension member first end 124 is connected with rotational freedom to a position internal to the cam 200 but eccentric to the cam axis of rotation 212. The rotation of the cam 200, therefore, serves as a levering function to reposition the location of the tension member connection axis 132. The greater the distance from the tension member connection axis 132 to the cam axis of rotation 212, the greater the change in location for a given degree of adjustment angle. A greater degree of adjustment angle results in a greater change in position as well. The simple machine levering is achieved about the pivot point which is the cam axis of rotation 212, and the two balanced ends of the lever are the positions of the tension member connection axis 132 and the actuation point of the cam 200, e.g., the location of the adjustment screw 240. As the distance between the location of the adjustment screw 240 and the tension member connection axis 132 is increased, the force required for adjustment of tension is decreased. The location of tension member connection axis 132 is important as the eccentric tension force will induce a rotational moment on the adjustment member. The cam 200 is configured to support any moment induced by the tensile force.

Once the adjustment of the rotational orientation of the cam 200 relative to the front housing 54 has been made, the adjustment screw 240 serves to secure (e.g., fix) the cam 200 to the front housing 54 in the desired cam rotational orientation, and the handle 140 can be moved relative to the fixed cam 200 between the handle first position and the handle second position.

Since the adjustment screw 240 is disposed between the handle 140 and the front housing 54, the adjustment screw 240 is located behind the handle 140 when the fence assembly 30 is viewed by a user of the saw device 1. Placement of the adjustment screw 240 in this location prevents adjustment of the cam rotational orientation when the fence assembly 30 is in a locked state and the tension forces are higher. When the fence assembly 30 is in an unlocked state and the handle 140 is in the second position, the adjustment screw 240 is exposed permitting adjustment of the cam rotational orientation, and thus of the tension force of the tension member 120, as discussed below. In the unlocked state, the tension forces are much lower and the adjustment is easier. This configuration allows for a fence tension adjustment mechanism 190 which does not have to function under higher loads and can therefore be more compact due to lower strength requirements.

Since the fence tension adjustment mechanism 190 including the cam 200 and adjustment screw 240 are disposed on the front housing 54, the fence tension adjustment mechanism 190 is easily accessible by a user standing at the front of the saw device 1. Moreover, the tension of the tension member 120 can be adjusted using the fence tension adjustment mechanism 190 without removing the fence assembly 30 from the table top 2.

Although the tension member 120 is described herein as being a rod, the tension member is not limited to this configuration. For example, in some embodiments, the tension member 120 may be a cable. A cable has the benefit of providing flexibility that can accommodate for friction induced bending and can maintain beneficial degrees of freedom in rotating members.

Although the table top 2 of the saw device 1 shown in the illustrated embodiments includes a pair of rails 20, 22, the saw device 1 is not limited to this configuration. For example, in some embodiments, a saw device having only one rail is contemplated. In these situations, locking may be achieved by clamping from the back side of the one rail.

Although the saw device 1 illustrated in the figures is, for example, a table saw, the saw device is not limited to being a table saw. In other embodiments, the saw device may be, for example, a band saw, a chop saw or other type of cutting tool in which a fence assembly is used to position a workpiece on a surface relative to the blade or other cutting element.

Selective illustrative embodiments of the portable table saw and fence assembly including a fence tension adjustment mechanism are described above in some detail. It should be understood that only structures considered necessary for clarifying certain features of the table saw and fence assembly have been described herein. Other conventional structures, and ancillary and auxiliary components of the portable table saw and the fence assembly are assumed to be known and understood by those skilled in the art. Moreover, while a working example of the portable table saw and fence assembly has been described above, the portable table saw and fence assembly are not limited to the working example described above, but various design alterations may be carried out without departing from the portable table saw, fence assembly and/or fence tension adjustment mechanism as set forth in the claims.

I claim:

1. A fence assembly that is configured to guide a workpiece with respect to a blade of a saw device and is supported for translation along rails relative to a work surface of the saw device, the fence assembly comprising:

a fence including a fence first end, and a fence second end that is opposed to the fence first end;

a slide mechanism coupled to the fence first end and supported on a first one of the rails;

a tensioning mechanism coupled to the fence second end and supported on a second one of the rails;

a handle that is supported on the slide mechanism via a cam, the handle being rotatable relative to the cam between a first position in which the fence assembly is fixed relative to the rails, and a second position in which the fence assembly is movable relative to the rails;

a tension member, the tension member including a first end that is coupled to the handle, the tension member including a second end that is opposed to the first end and coupled to the tensioning mechanism; and a fence tension adjustment mechanism that is configured to adjust a tension force of the tension member, the fence tension adjustment mechanism including the cam, the cam including an outer bearing surface that is rotatably supported on a housing of the slide mechanism, and an inner bearing surface that rotatably supports the handle, where the inner bearing surface is positioned eccentrically with respect to the outer bearing surface; and an adjustment screw that is coupled to the cam and engages the housing, the adjustment screw configured to adjust a rotational orientation of the cam relative to the housing, wherein the cam is rotatable relative to the slide mechanism about a cam rotational axis, and rotation of the cam relative to the cam rotational axis provides an adjustment of a tension force applied by the tension member.

2. The fence assembly of claim 1, wherein the tension member is coupled to the handle via a pivot pin, rotation of the cam relative to the cam rotational axis changes a position of the pivot pin relative to the fence first end, and a change in the position of the pivot pin relative to the fence first end changes a tension force applied by the tension member to the tensioning mechanism.

3. The fence assembly of claim 1, wherein the handle is rotatable relative to the cam about a handle rotational axis, and the cam rotational axis is parallel to, and spaced apart from, the handle rotational axis.

4. The fence assembly of claim 1, wherein the tension member has a first end that is connected to the handle via a pivot pin that defines a tension member connection axis, the handle is rotatable relative to the cam about a handle rotational axis, and the handle rotational axis is parallel to, and spaced apart from, the tension member connection axis.

5. The fence assembly of claim 1, wherein the handle is rotatable between the first position in which the tension member is under a first tension force and the slide mechanism and the tensioning mechanism are fixed relative to the rails, and the second position in which the tension member is under a second tension force and the front and rear housings are movable relative to the rails, where the second tension force is less than the first tension force.

6. The fence assembly of claim 1, wherein the tension member is a rod.

7. The fence assembly of claim 1, wherein the cam includes an outer bearing surface that is rotatably supported on a housing of the slide mechanism, and an inner bearing surface that rotatably supports the handle, where the inner bearing surface is positioned eccentrically with respect to the outer bearing surface.

8. The fence assembly of claim 1, wherein the cam is rotatable relative to the housing between a cam first rotational orientation in which the tension member has a first tension force and a cam second rotational orientation in which the tension member has a second tension force, and the first tension force is greater than the second tension force.

9. The fence assembly of claim 1, wherein the adjustment screw is configured to secure the cam to the housing in a desired cam rotational orientation.

10. The fence assembly of claim 1, wherein the adjustment screw rotates the cam relative to the front housing between a cam first rotational orientation in which a tension member connection axis is a first distance from an end of the fence, and a cam second rotational orientation in which the tension member connection axis is a second distance from the end of the fence, the first distance is different from the second distance, and the amount of tension provided in the tension member corresponds to a distance of the tension member connection axis from the end of the fence.

11. The fence assembly of claim 1, wherein when the handle is in the first position, the handle obstructs access to the adjustment screw and when the handle is in the second position, the handle does not obstruct access to the adjustment screw.

12. The fence assembly of claim 1, wherein the cam comprises a first annular member and a second annular member, and the second annular member is keyed to the first annular member so as to rotate in concert with the first annular member.

13. The fence assembly of claim 1, wherein the cam comprises a first annular member and a second annular member, the first annular member includes a first inner edge, a first outer edge that surrounds the first inner edge, a first handle-facing surface that extends between the first outer edge and the first inner edge, and a first protrusion that protrudes from the first handle-facing surface, and the second annular member includes a second inner edge, a second outer edge that surrounds the second inner edge, a second handle-facing surface that extends between the second outer edge and the second inner edge, and a second protrusion that protrudes from the second handle-facing surface, the second protrusion including a groove that receives, and engages with, the first protrusion.

14. The fence assembly of claim 13, wherein an adjustment screw is coupled to the cam and engages the slide mechanism, the adjustment screw configured to adjust a rotational orientation of the cam relative to the slide mechanism.

15. The fence assembly of claim 13, wherein the handle comprises a cylindrical axle that protrudes bilaterally from a first end of the handle, the first annular member is disposed on one side of the handle with a first portion of the axle supported on the first inner edge, and the second annular member is disposed on another side of the handle with a second portion of the axle supported on the second inner edge.

16. A saw device including a fence assembly that is supported relative to a work surface of the saw device via a first rail and a second rail of the saw device, the fence assembly comprising:

a fence;

a slide mechanism disposed on a first end of the fence, the slide mechanism including a housing configured to engage with the first rail;

a tensioning mechanism disposed on a second end of the fence, the tensioning mechanism configured to engage with the second rail;

a handle that is supported on the slide mechanism, the handle being movable relative to the slide mechanism between a first position and a second position;

a tension member, the tension member including a first end that is coupled to the handle and a second end that is coupled to the tensioning mechanism; and a fence tension adjustment mechanism that is configured to adjust a tension force of the tension member, wherein when the handle is in the first position, a first tension force is applied by the tension member to the tensioning mechanism and when the handle is in the second position, a second tension force is applied by the tension member to the tensioning mechanism, the second tension force being less than the first tension force, the fence tension adjustment mechanism including a cam that is supported on the slide mechanism so as to be rotatable about a cam rotational axis, the cam configured to support the handle so that the handle is rotatable about a handle rotational axis that is parallel to, and spaced apart from, the cam rotational axis, and an adjustment screw that passes through an opening in the cam and engages the housing, the adjustment screw configured to adjust a rotational position of the cam relative to the housing.

* * * * *